United States Patent [19]

Coenen

[11] 3,990,113

[45] Nov. 9, 1976

[54] FASTENING MEANS FOR A CRASH HELMET

[76] Inventor: Willem Frans Coenen, Blauwe Akelei 9, Wateringen, Netherlands

[22] Filed: May 19, 1975

[21] Appl. No.: 578,856

[30] Foreign Application Priority Data

May 22, 1974 Netherlands ..... 7406933

[52] U.S. Cl. ..... 2/421; 24/230 AL; 24/230 AN

[51] Int. Cl.[2] ..... A42B 7/00; A44B 19/00

[58] Field of Search ..... 2/421, 3 R; 24/230 AL, 24/230 AN

[56] References Cited

UNITED STATES PATENTS

| | | | |
|---|---|---|---|
| 3,203,065 | 8/1965 | Hoppenstand | 24/230 AL |
| 3,538,558 | 11/1970 | Croft | 24/230 AL |
| 3,555,632 | 1/1971 | Lindblad | 24/230 AL |

FOREIGN PATENTS OR APPLICATIONS

| | | | |
|---|---|---|---|
| 1,328,405 | 4/1963 | France | 24/230 AL |
| 1,409,848 | 7/1965 | France | 24/230 AL |

*Primary Examiner*—Werner H. Schroeder
*Assistant Examiner*—Conrad L. Berman
*Attorney, Agent, or Firm*—Sughrue, Rothwell, Mion, Zinn & Macpeak

[57] ABSTRACT

A fastening assembly for crash helmets is disclosed. The assembly is characterized in that the locking elements comprise a locking pin which is spring biased and slidable between two shoulders in a male member. The locking pin is approximately an I-shaped cross section with the I having two flanges and a web. The male member comprises a rigid tongue-shaped section having in its end a recess through which the closed position of the fastening of the web of the locking pin projects, and the inner limiting faces of the flanges are chamfered such that the tongue, when being inserted, acts on an oblique face pushing the pin away against the biasing action of the spring.

1 Claim, 7 Drawing Figures

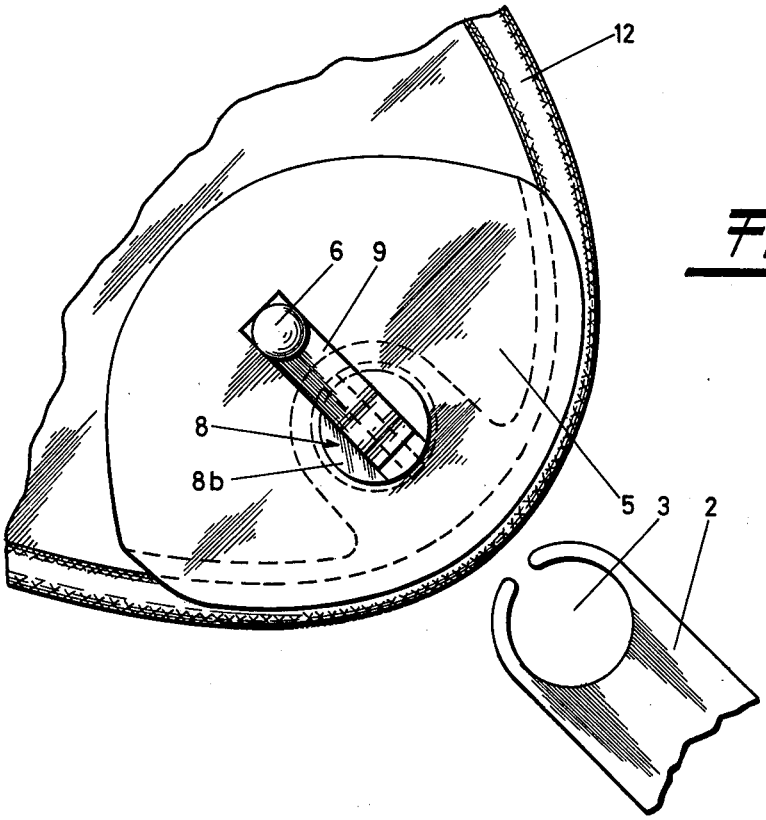
FIG. 5
FIG. 6
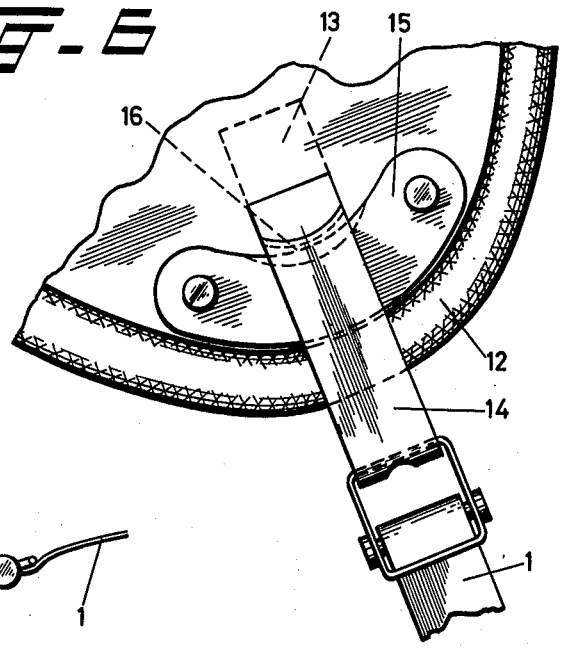
FIG. 7
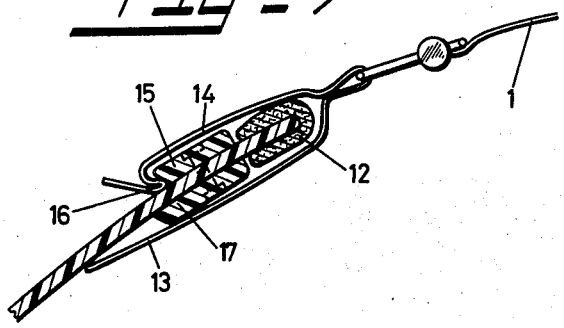

FASTENING MEANS FOR A CRASH HELMET

BACKGROUND OF THE INVENTION

This invention relates to a crash-helmet, in particular for motorcyclists and riders of autocycles, comprising a chin strap with fastening.

In the case of known crash-helmets, the chin strap comprises two parts each fastened to a side wall of the helmet. One part is equipped with a clasp. When closing the chin strap, one should braid the end of the other part through the clasp. In doing so, one always needs two hands which is found to be inconvenient.

The invention aims at avoiding this drawback, and at providing a crash-helmet of the type mentioned in the introduction, the chin strap of which is adapted to be easily put into the closed position by one hand.

For this purpose, according to the invention, the fastening comprises a female member and a male member one of these members being rigidly connected to a side wall of the helmet and the other member being secured to the free end of the chin strap and being adapted to be brought with one hand into or on the rigidly connected member, a locking means being provided for releasably locking the members of the fastening.

SUMMARY OF THE INVENTION

A safe, handy and aestetically justified embodiment of the afore-mentioned fastening principle is, according to the invention, characterized in that the locking means consists of a locking pin which is spring-biased and slidable between two shoulders in the male member, said locking pin being approximately I-shaped in cross-section transversely to the direction of insertion, the I having two flanges and a web, the pin being adapted to be operated via an aperture in the helmet shell, that the male member comprises a rigid tongue having in its end, a recess through which in the closed position of the fastening the web of the locking pin projects and that, viewed in the direction of insertion of the tongue, the inner limiting faces of the flanges are chamfered such that the tongue upon being inserted acts on an oblique face pushing the pin away against the action of the spring.

In order to observe from the outside of the helmet an uninterrupted appearance of the helmet side at the point where the receiving part is located, it is preferred that in the closed position of the fastening, one of the flanges of the locking pin merges with the outer face of the helmet shell.

A less attractive but simpler and cheaper embodiment of a crash-helmet according to the invention comprises a female member having two resilient clamping arms, the locking means being constituted by a loop-like backwardly bent part of one of the arms, and the male member comprising a strip arranged on the helmet shell with a recess adapted to engage with said loop-like backwardly bent part.

The safety of the fastening according to this simple principle is enhanced if the strip arranged on the helmet shell is concavely bent at its rim remote from the helmet rim.

BRIEF DESCRIPTION OF THE DRAWINGS

The invention will now be further explained with reference to the Figures, showing two embodiments.

FIG. 5 shows on an enlarged scale a detail of the side wall of the helmet at the point of the fastening, viewed from the inside.

FIG. 6 shows a second embodiment of the fastening according to the invention, part of the side wall of the helmet and the fastening being shown.

FIG. 7 shows a longitudinal section of the part according to FIG. 6.

DESCRIPTION OF THE PREFERRED EMBODIMENT

Figure 1:
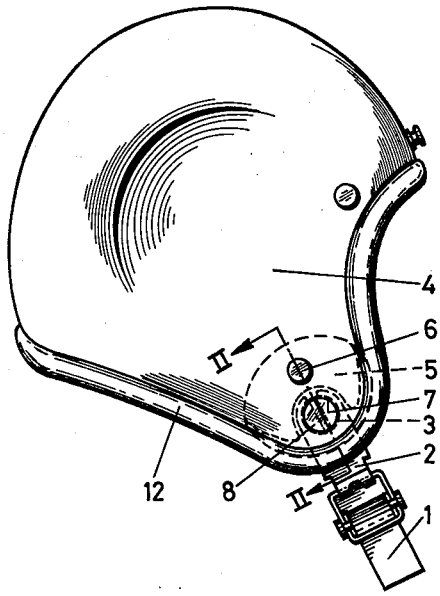
FIG. 1 shows a first embodiment of a helmet according to the invention in side view and at the point of the closing side of the chin strap.
Figure 2:
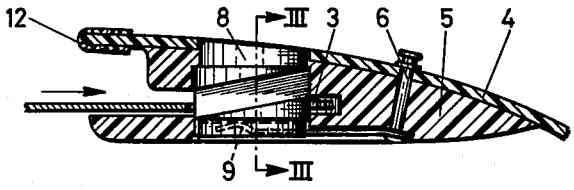
FIG. 2 shows a longitudinal section of the fastening according to the line II—II in FIG. 1, said fastening being in the fastened position.

The crash-helmet in the case of the embodiment to FIGS. 1–5 incl. comprises a one-piece chin strap 1 which is provided at the free end with a male member shaped like a rigid metal tongue 2. Said tongue comprises a round hole 3.

At the inside of a side wall of the helmet 4 a female member 5 is rigidly provided with the aid of a nail 6. Said part 5 comprises a mainly cylindrical bore in line with a round opening 7 in the shell of the helmet.

Inside the bore, a round locking pin 8 is slidably arranged. From FIGS. 2 and 4 it is apparent that the bore and the pin 8 comprise shoulders which limit the shifting range and prevent the pin from dropping out.

At the inside of the helmet, the pin 8 is always pushed outwards by a leaf spring 9.

Figure 3:
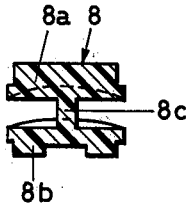
FIG. 3 shows a cross-section through the locking knob according to the line III—III, taken exclusively across the locking pin in FIG. 2.
Figure 4:
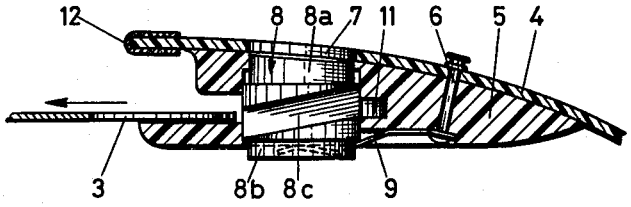
FIG. 4 shows a longitudinal section comparable with FIG. 2 but in unlocked position, the locking pin being depicted in the pressed-in position.

From FIG. 3, it is apparent that the locking pin 8 in cross-section is I-shaped with two flanges **8*a*, 8*b* and a web 8*c*. Flange 8*b* comprises a groove for receiving the leaf-spring 9**.

It is important that the faces of the flanges **8*a* and 8*b*, facing one another, are chamfered. It is apparent from FIGS. 2 and 4 that in the closed position, in which the tongue 2 is accommodated in the female member 5, the hole 3 surrounds the web 8*c* of the locking pin. In order to get the tongue into said position its end is pushed against the chamfered limiting face of the flange 8*b*, the pin being pushed away against the action of the spring 9. At the moment at which the end of the tongue arrives in the groove 11 in part 5, the hole 3 registers with the pin 8 so that the latter is pushed back by the spring 9 to the initial position according to FIG. 2. Tongue 2 is now locked which means that it cannot simply be withdrawn from the female member 5. Unlocking is done by pushing with a finger the pin 8 via the opening 7 inwards into the position according to FIG. 4**.

The fastening described is very safe and may be manipulated with one hand. At the outside of the helmet only pin 8 and nail 6 are visible. As is apparent from FIG. 2, in the closed position, the outer face of flange 8a is flush with the outer face of the helmet shell 4.

The shape of the female member 5 is adapted to the shape of the side wall of the helmet such that no sharp transitions are formed (see in particular FIG. 5), which in the event of a crash, might turn out to be dangerous.

Around the edge of the helmet, a usual ornamental rim 12 is shown.

In the case of the second embodiment, according to FIGS. 6 and 7, there is provided at the free end of the chin strap 1 a clamping clip consisting of two springs 13,14 with spring action towards one another. At one side wall of the helmet 4, there is fastened a strip 15, which at the side remote from the helmet edge comprises a notch or recess. The arm 14 comprises a loop-like, backwardly bent part 16 acting as a locking means and being adapted to engage said notch or recess of strip 15.

In order to protect the ornamental rim 12, a strip 17 is provided at the side of the resilient arm 13, facing the strip 15.

The locking will benefit if, as shown in FIG. 6, the rim or strip 15, remote from the helmet rim, is concavely bent.

In this embodiment, closing the chin strap may be effected by pushing the female member comprising arms 13,14 over the strips 15,17 until the loop-like part 16 snaps into said notch or recess.

Unlocking is done by pulling the loop 16 outwards.

The embodiment according to FIGS. 6 and 7 is simpler but aesthetically not so attractive as the one according to FIGS. 1 to 5 inclusive; the arm 14 is visible at the outside.

Many changes of details of the embodiments shown are possible within the scope of the claims.

I claim:

1. In a crash-helmet having a chin strap and a fastening means for said strap, wherein the improvement comprises said fastening means comprising a female portion rigidly secured to a side wall of the helmet and faired to the shape thereof, a male portion secured at the free end of the chin strap and having a C-shaped tongue at the end thereof, said female portion having a hole through which a spring biased locking pin slidably extends, said pin having an intermediate web, said web fitting between the ends of the C-shaped tongue of the male portion, and said pin having an outer end surface arranged in said hole such that said pin may be depressed slidably in said hole, and said pin being provided with a plurality of channels with said web forming a common wall such that said male member is guided in such channels into a locked position, and unlocked by depression of said pin.

* * * * *